United States Patent [19]

Baba et al.

[11] Patent Number: 4,473,770

[45] Date of Patent: Sep. 25, 1984

[54] BASELESS INCANDESCENT LAMP ASSEMBLY

[75] Inventors: Masaharu Baba, Yokohama; Kiyokazu Honda, Zushi; Akiyoshi Hashima, Yokohama, all of Japan

[73] Assignee: Tokyo Shibaura Denki Kabushiki Kaisha, Yokohama, Japan

[21] Appl. No.: 508,423

[22] Filed: Jun. 27, 1983

Related U.S. Application Data

[63] Continuation of Ser. No. 213,078, Dec. 4, 1980.

[30] Foreign Application Priority Data

Dec. 20, 1979 [JP] Japan ..... 54-165984

[51] Int. Cl.[3] ..... H01J 5/48; H01J 5/50

[52] U.S. Cl. ..... 313/318; 313/315; 339/59 L; 339/176 L; 362/226; 362/267

[58] Field of Search ..... 313/318, 315, 113; 362/226, 267, 227; 339/74 L, 59 L, 144 R, 145 R, 176 L

[56] References Cited

U.S. PATENT DOCUMENTS

| | | | |
|---|---|---|---|
| 3,262,001 | 7/1966 | Rijckeart | 313/318 |
| 3,555,341 | 1/1971 | Curtis | 313/318 |
| 4,013,335 | 3/1977 | Varkonyi et al. | 313/318 |
| 4,100,448 | 7/1978 | Chipner et al. | 313/318 |
| 4,114,066 | 9/1978 | Wiedenmann | 313/318 |
| 4,122,367 | 10/1978 | Esklavon et al. | 313/318 |
| 4,146,814 | 3/1979 | Wojtowicz | 313/318 |
| 4,181,390 | 1/1980 | Aizawa | 339/176 L |
| 4,318,158 | 3/1982 | Livermore et al. | 362/226 |

*Primary Examiner*—Saxfield Chatmon

*Attorney, Agent, or Firm*—Cushman, Darby & Cushman

[57] ABSTRACT

A baseless incandescent lamp assembly comprises a baseless incandescent lamp including a flattened seal section and a pair of external lead wires, a main socket body including a lamp holding chamber to contain the flattened seal section of said baseless incandescent lamp, and a pair of conductive holding members provided in the lamp holding chamber of the main socket body and holding the flattened seal section. Said external lead wires are held and electrically connected to the conductive holding members by being pressed between the conductive holding members and the inner surfaces of the lamp holding chamber.

7 Claims, 9 Drawing Figures

BASELESS INCANDESCENT LAMP ASSEMBLY

This is a continuation of application Ser. No. 213,078, filed Dec. 4, 1980.

This invention relates to a baseless incandescent lamp assembly consisting of a baseless incandescent lamp and a socket to hold the lamp.

Baseless incandescent lamps are generally used as illuminating light sources for dashboards of vehicles, and are available in combination with sockets for exclusive use. Such a socket has a lamp holding chamber in which the flattened seal section of a baseless incandescent lamp is inserted and a holding member formed by bending a metal plate which is previously fixed in the lamp holding chamber, and is so designed as to be able to be mounted on a printing substrate on the back side of a dashboard. The baseless incandescent lamp is fixedly held in the socket when it is inserted in the lamp holding chamber to have its flattened seal section pinched by the holding member. The external lead wires of the baseless incandescent lamp, extending along the outside surface of the flattened seal section, are held between and pressed by the flattened seal section and the holding member to be in electrical contact with the holding member. As a result, the baseless incandescent lamp held in the socket is supplied with electric power through the holding member.

In the combination of the baseless incandescent lamp and the socket of the aforementioned construction, however, the external lead wires are liable to slip off the outside surface of the flattened seal section, and often fail to be securely held between the holding member and the flattened seal section, thereby causing defective electrical contact.

Since the baseless incandescent lamp of this type, in use, is mounted on the back side of a dashboard, as mentioned above, so that it requires a great deal of labor to replace a defective baseless incandescent lamp assembly with new one.

Moreover, such prior art baseless incandescent lamp assembly is not suited for mass production because it requires troublesome manufacturing operations; it is necessary that holding members be inserted and fixed one by one in the lamp holding chambers of holders to form sockets, and that baseless incandescent lamps be fitted in these sockets one at a time.

Accordingly, the object of this invention is to provide a baseless incandescent lamp which is not liable to defective electrical contact and is adapted for mass production, requiring only easy manufacturing operations.

This invention can be more fully understood from the following detailed description when taken in conjunction with the accompanying drawings, in which:

FIGS. 1 to 6 show a baseless incandescent lamp assembly according to an embodiment of this invention, in which FIG. 1 is a disassembled perspective view, FIG. 2 is a side view, FIG. 3 is a plan view, FIG. 4 is a sectional view as taken along line IV—IV of FIG. 3, and FIG. 5 is a sectional view as taken along line V—V of FIG. 3;

FIG. 6 is a sectional view as taken along line VI—VI of FIG. 3 formed of the intermediate product of FIG. 5;

Figure 1:
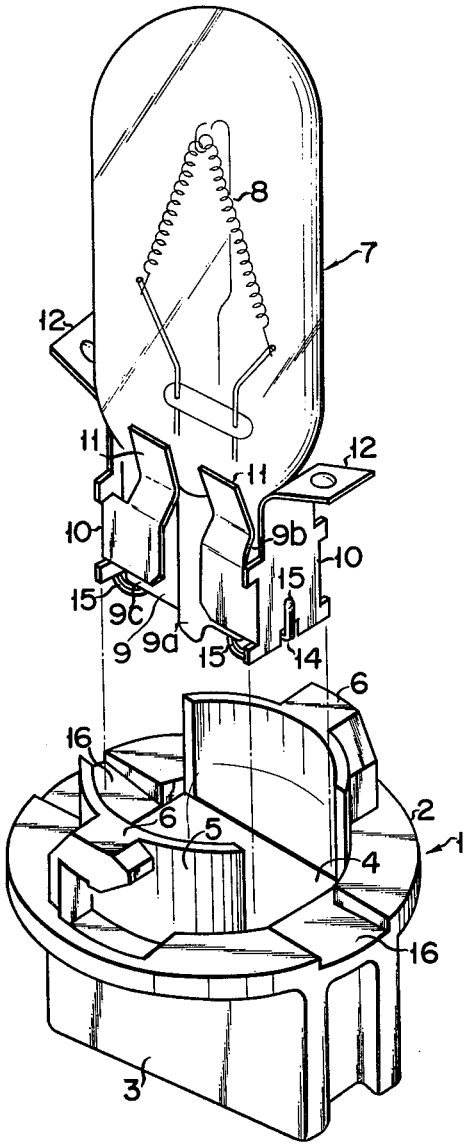
Figure 2:
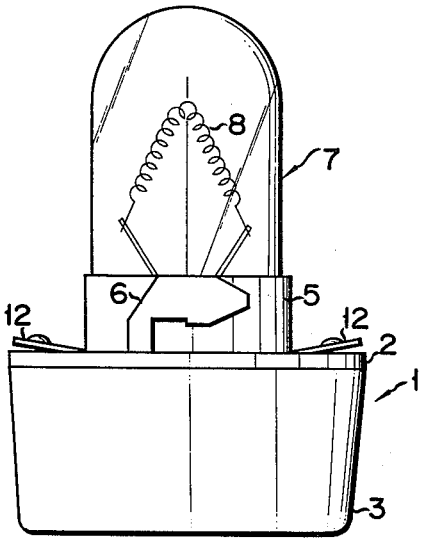
Figure 3:
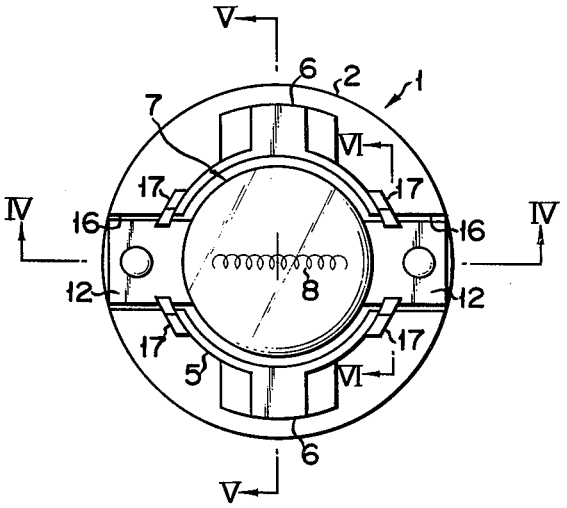
Figure 4:
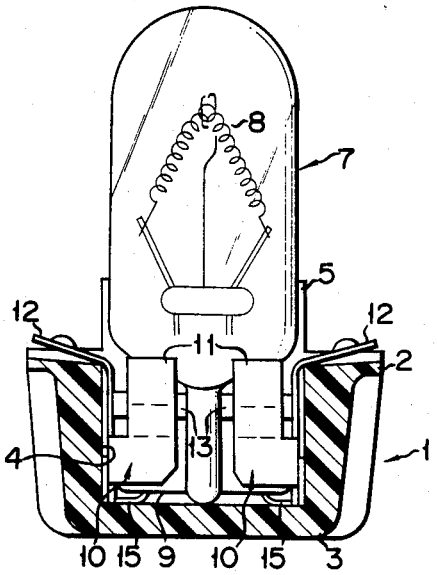
Figure 5:
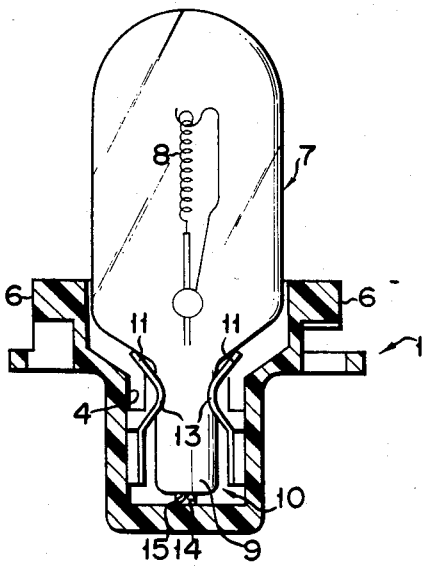
Figure 6:
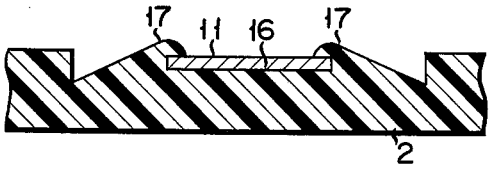

Now there will be described a baseless incandescent lamp according to an embodiment of this invention with reference to the accompanying drawings.

Referring first to FIGS. 1 to 6, the construction of the baseless incandescent lamp to be manufactured will be described to facilitate the understanding of the invention.

In these figures, numeral 1 designates a main body of a lamp socket. The main lamp socket body 1, which is formed by integrally molding thermoplastic synthetic resin, includes a circular flange section 2 and a knob section 3 on the back side of the flange section 2. Defined in the main socket body 1 is a lamp holding chamber 4 opening in the front of the flange section 2. The lamp holding chamber 4 is substantially in the form of a rectangle defined by wide front and rear sides and narrow lateral sides. A pair of fitting edge sections 5 protrude from the front of the flange section 2, located around the opening of the lamp holding chamber 4. These fitting edge sections 5 each have an inside face with such radius of curvature that they may engage the front and rear sides of the bulb of a baseless incandescent lamp held in the socket body, thereby preventing the bulb from wobbling. Severally from the outside faces of the fitting edge sections 5 protrude stopping projections 6 spaced at a given distance from the front face of the flange section 2. When the main socket body 1 is inserted and turned in a mounting hole in a printed substrate (not shown), the mounting hole edge of the printed substrate is held between the flange section 2 and the stopping projections 6 so that the socket may be mounted on the printed substrate.

Numeral 7 designates a baseless incandescent lamp which has a flattened seal section 9 formed by flattening the bottom portion of a cylindrical bulb and a filament 8 contained in the bulb. The flattened seal section 9 of the baseless incandescent lamp 7 is divided into left and right portions **9*b* and 9*c* by an exhaust tube 9*a*. Holding members 10 are attached severally to the left and right portions 9*b* and 9*c*. These holding members 10 are formed by pressing a brass plate, each having a facing pair of pinch strips 11 and a contact strip 12 which is bent substantially at right angles to the pinch strips and stretched therebetween to couple the same. The pinch strips 11 have at their middle portions their respective pinch sections inwardly bent so as to approach each other. Thus, the baseless incandescent lamp 7 inserted between these pinch strips 11 has the left and right portions 9*b* and 9*c* of its flattened seal section 9 held severally between the pinch sections of the two pinch strips 11 by the spring action thereof. To ensure such holding, engaging grooves 13 are formed respectively at the basal parts of the front and rear sides of the flattened seal section 9 so that the pinch sections of the pinch strips 11 may be fitted in the grooves 13. The holding members 10 have a common open bottom side, and a lead wire notch 14 extends upward from the bottom end of each contact strip 12. A pair of external lead wires 15 of the baseless incandescent lamp 7 have their one ends electrically connected with the filament 8 and the other ends passing through the left and right seal portions 9*b* and 9*c* and extended from the bottom ends thereof to the outside. The outwardly extended external lead wires 15 are doubled and bent respectively toward both flanks of the baseless incandescent lamp 7. The tip end of each doubled lead wire 15 is bent upward at a point where it outwardly passes through the notch 14 of its corresponding contact strip 12, and extends along the outside face of the contact strip 12. Hereupon, the contact strip 12 may be in contact with or kept apart from the bent tip end portion of the doubled lead wire 15. The flattened seal section 9 of the baseless incandescent lamp 7 and the pair of holding members 10 pinching the flattened sealing section 9 therebetween are inserted in the lamp holding chamber 4 of the main socket body 1. The dimensions of the lamp holding chamber 4 are such that no substantial gap may be left between the outer peripheral surfaces of the paired holding members 10 holding the flattened seal section 9 and the inner peripheral surface of the holding chamber 4. Namely, the width of the holding chamber 4 is a little greater than the distance between the respective contact strips 12 of the two holding members 10, and the depth of the chamber 4 is a little greater than the distance between the pinch strips 11 of each holding member 10. As a result, the end portion of each external lead wire 15 extending along the outside face of the contact strip 12 of its corresponding holding member 10 inserted in the lamp holding chamber 4 is held between the outside face of the contact strip 12 and the inside wall of the holding chamber 4, so that the electrical contact between the end portion of the lead wire 15 and the holding member 10** is secured.

The top portions of the contact strips 12 are bent so as to be severally fitted in a pair of grooves 16 which are formed in the front of the flange section 2 of the main socket body 1, extending in the radial direction of the flange section 2. The top end portions of the contact strips 12 are projected a little ahead of the front of the flange section 2 so that they may elastically abut against power supply terminals of the prined substrate to be supplied with power when the main socket body 1 is mounted on the printed substrate. Respectively formed on both sides of the basal parts of the grooves 16 are caulked portions 17 which project on both side edges of the contact strips 12 to prevent the holding members 10 from slipping off the socket body.

The caulked portion 17 may be easily made by the following manner.

Figure 7:
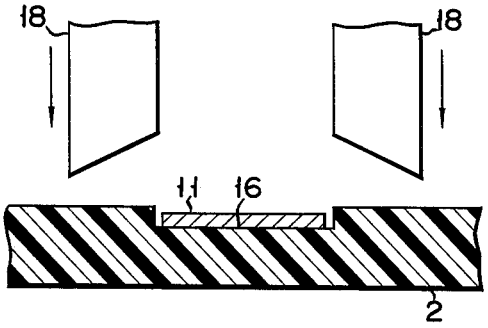
FIGS. 7 and 8 are sectional views successively showing the way of the heat treatment to form a caulked portion shown in FIG. 6.
Figure 8:
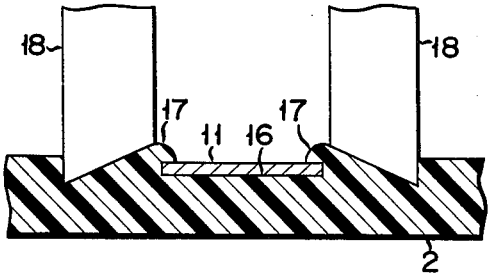

There is firstly prepared an ultrasonic oscillator having four projections 18 corresponding to both sides of the basal parts of the pair of grooves 16 of the flange section 2, the tip ends of these projections 26 being upwardly inclined toward the center lines of the grooves 16 as shown in FIG. 7. The inclined end portions of the projections 18 are pressed against both sides of the grooves 16 to heat and soften the same. Then, as the inclined end portions of the projections 18 are forced into the flange section 2, softened resin is pushed toward the grooves 16 to be projected onto the top of the contact strips 12, thereby forming the caulked portions 17, as shown in FIG. 8. The projected caulked portions 17 enable the holding members 10 to be fixedly held in the main socket body 1 are prevented from slipping off the socket body.

In the above-described assembly the portions 17 are formed by deforming the main socket body 1 by means of heat treatment, thereby preventing the holding members 10 from slipping out of the socket body 1. Instead, the holding member 10 may be secured to the socket body 1 by another means, which will be described with reference to FIG. 9 wherein like and the same parts are denoted by like and the same numerals as used in FIG. 1.

Figure 9:
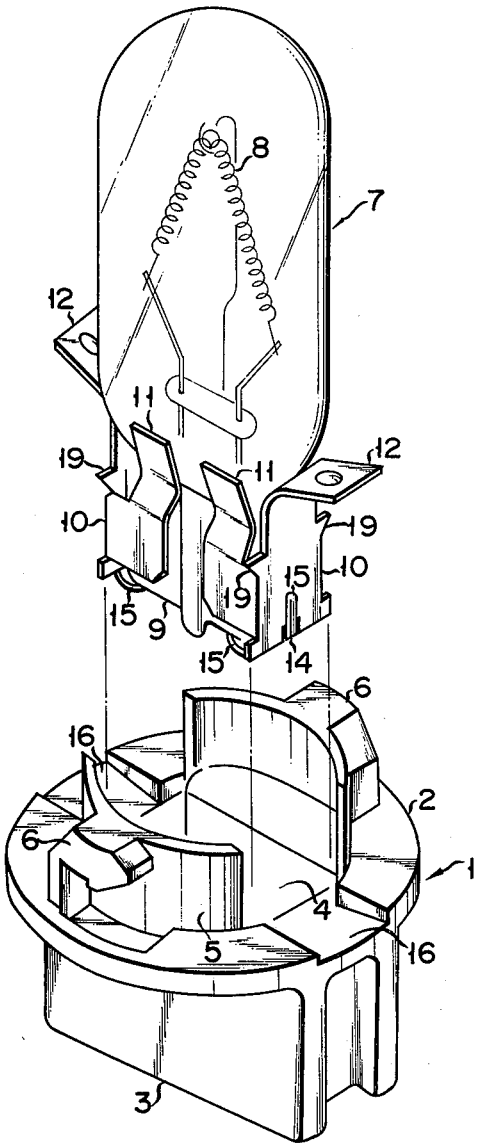
FIG. 9 is a disassembled perspective view showing a baseless incandescent lamp assembly according to another embodiment of this invention.

As shown in FIG. 9, a holding member 10 has a contact strip 12 which has two protrusions 19 integral with the strip 12 and extending in the opposite directions from the sides of the strip 12. The distance between the free ends of the protrusions 19 is slightly longer than a lamp holding chamber 4 is broad. The lower side of each protrusion 19 is tapered so that the protrusion 19 is gradually slender toward its free end.

When the holding member 10 of such structure as shown in FIG. 9 is pushed into the lamp holding chamber 4 of a main socket body 1, the protrusions 19 bite respectively into the front and back walls which define the chamber 4. As a result, the holding member 10 is held immovable by the main socket 1.

Alternatively, the holding member 10 and the main socket body 1 may be connected to each other by means of an adhesive.

In the baseless incandescent lamp assembly as described above, the external lead wires are securely held between the holding members and the inner peripheral walls of the lamp holding chamber, so that there is no possibility of defective contact. The electrical connection between the external lead wires and the holding members is not limited to the case of the above-mentioned embodiment in which is obtained the hold of the lead wires between the contact strips of the holding members and the inner peripheral walls of the main socket body, and such connection may also be obtained holding the lead wires between the pinch strips and the inner peripheral walls, for example.

What we claim is:

1. A baseless incandescent lamp assembly comprising:

(a) a baseless incandescent lamp including a flattened seal section and a pair of external lead wires outwardly leading from the flattened seal section;

(b) a main socket body including inner surfaces defining a lamp holding chamber to contain the flattened seal section of said baseless incandescent lamp; and (c) a pair of conductive holding members provided in the lamp holding chamber of the main socket body for holding the flattened seal section of the baseless incandescent lamp; and (d) means permitting said external lead wires to be pressingly disposed between the conductive holding members and the inner surfaces of the main socket body for securely holding said external lead wires and for ensuring electrical connection between said lead wires and said conductive holding members, wherein each of said conductive holding members includes an opposing pair of pinch strips and a contact strip coupling said pinch strips, clamping and thus supporting said flattened seal portion of the baseless incandescent lamp therebetween, and wherein said contact strip includes holding means defining a pair of opposing projections extending from both sides of said contact strip for biting into predetermined opposing ones of said inner surfaces of the lamp holding chamber to securely hold said contact strip between said predetermined opposing ones of said inner surfaces.

2. A baseless incandescent lamp assembly according to claim 1, wherein said means sub (d) permits each of the external lead wires to be pressingly disposed between a respective one of said contact strips and its associated inner surface of the main socket body.

3. A baseless incandescent lamp assembly according to claim 2, wherein said means sub (d) includes a slit defined in the lower edge of said contact strip through which an external lead wire is extended between the contact strip and the inner surface of the main socket body.

4. A baseless incandescent lamp assembly according to claim 3, wherein said main socket body includes a flange section at which the lamp holding chamber opens, the upper edge of the contact strip being extended along the flange section.

5. A baseless incandescent lamp assembly according to claim 4, wherein the contact strip is attached to the flange section of the main socket body.

6. A baseless incandescent lamp assembly comprising:

(a) a baseless incandescent lamp including a flattened seal section and a pair of external lead wires outwardly leading from the flattened seal section;

(b) a main socket body including inner surfaces defining a lamp holding chamber to contain the flattened seal section of said baseless incandescent lamp; and (c) a pair of conductive holding members provided in the lamp holding chamber of the main socket body for holding the flattened seal section of the baseless incandescent lamp; and (d) means permitting said external lead wires to pressingly disposed between the conductive holding members and the inner surfaces of the main socket body for securely holding said external lead wires and said conductive holding members, wherein (i) each of said conductive holding members includes an opposing pair of pinch strips and a contact strip coupling said pinch strips, said pinch strips clamping and thus supporting said flattened seal portion of the baseless incandescent lamp therebetween;

(ii) said means sub (d) permits each of the external lead wires to be pressingly disposed between a respective one of said contact strips and its associated inner surface of the main socket body; and (iii) said contact strip includes holding means defining a pair of opposing projections extending from both sides of said contact strip for biting into predetermined opposing ones of said inner surfaces of the lamp holding chamber to securely hold said contact strip between said predetermined opposing ones of said inner surfaces.

7. A baseless incandescent lamp assembly according to claim 6, wherein said means sub (d) includes a slit defined in the lower edge of said contact strip through which an external lead wire is extended between the contact strip and the inner surface of the main socket body.

* * * * *